US005461374A

United States Patent [19]

Lewiner et al.

[11] Patent Number: 5,461,374

[45] Date of Patent: Oct. 24, 1995

[54] SYSTEMS FOR INFORMING USERS ABOUT WAITING TIMES FOR BUSES AT STOPS IN A NETWORK

[75] Inventors: Jacques Lewiner, Saint-Cloud; Eric Carreel, Paris, both of France

[73] Assignee: Jean-Claude Decaux, Neuilly-sur-Seine, France

[21] Appl. No.: 211,084

[22] PCT Filed: Jul. 20, 1993

[86] PCT No.: PCT/FR93/00738

§ 371 Date: May 18, 1994

§ 102(e) Date: May 18, 1994

[87] PCT Pub. No.: WO94/02922

PCT Pub. Date: Feb. 3, 1993

[30] Foreign Application Priority Data

Jul. 22, 1992 [FR] France ..... 92 09043

[51] Int. Cl.[6] ..... G08G 1/123

[52] U.S. Cl. ..... 340/994; 364/436

[58] Field of Search ..... 340/994, 539, 340/991; 364/436

[56] References Cited

U.S. PATENT DOCUMENTS 3,886,515 5/1975 Cottin et al. ..... 340/994

4,713,661 12/1987 Boone et al. ..... 340/994

FOREIGN PATENT DOCUMENTS 0219859 4/1987 European Pat. Off. .

4039800 2/1992 Japan ..... 340/994

2178210 2/1987 United Kingdom .

OTHER PUBLICATIONS

Patent Abstracts of Japan, vol. 14, No. 581 (p–1147) 26 Dec. 1990, & JP–A–22 50 199 (Omron Tateisi Electron Co.) 5 Oct. 1990.

*Primary Examiner*—Brent Swarthout

*Attorney, Agent, or Firm*—Larson & Taylor

[57] ABSTRACT

A system for informing users of a bus network about waiting times for buses at stops of the network comprises means (3–6) for generating and transmitting electrical signals representative of the distance (d) between each bus (1) and the "next" stop (2), and means (7) associated with each stop and organized to receive said signals, to select therefrom those signals that concern said stop, and to display at said stop data relating to the waiting times for the "approaching" buses. The system also includes means for generating electrical signals representative of two past real average bus speeds relating to two different periods immediately before the instant at which the signals are generated, and means for using the average speeds in order to determine the waiting times to be displayed.

4 Claims, 1 Drawing Sheet

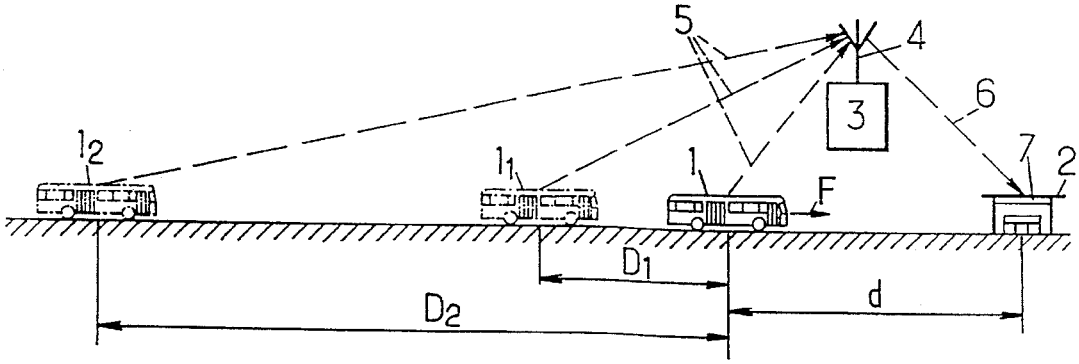
5
4
3
6
$1_2$
$1_1$
1
F
7
2
$D_1$
$D_2$
d

SYSTEMS FOR INFORMING USERS ABOUT WAITING TIMES FOR BUSES AT STOPS IN A NETWORK

BACKGROUND OF THE INVENTION

1. Field of the Invention

The invention relates to systems for informing users at stops in bus networks about waiting times for buses.

2. The Prior Art

More particularly, of such systems, the invention relates to those comprising:

firstly transmitter facilities for generating electrical signals representative of the distance between each bus travelling along a line of the network and the "next" stop served by said bus, and for transmitting said signals in particular over an electromagnetic path; and secondly receiver members associated with at least one stop and organized to receive said signals, to select from said signals those that concern said stop directly or otherwise, to generate data relating to the waiting time for each "approaching" bus on the basis of the signals selected in this way, and to display said data.

In known systems of that kind, proposals have already been made for the data as displayed to be in the form specifically of the waiting times for the buses approaching the stops in question.

Each waiting time is deduced from the detected distance between a bus and the stop, and by making use of the average speed of a bus on its line.

This "average speed" parameter is generally in the form of fixed data that is recorded permanently in the corresponding calculation devices.

The use of such a constant value parameter can give satisfaction, particularly when buses are progressing normally along the line that includes the stop concerned by the display, i.e. when traffic conditions on the line are average, with account being taken of the time required for stops at traffic lights, of traffic density at the instant under consideration, . . .

However, the above-defined average speed can take values that are very different.

Of the factors which can change that parameter, a distinction should be drawn between those that are predictable and those that are not.

Predictable factors include the time of day at which the display is taking place: it is well known that urban traffic density varies considerably with time of day, with a bus being able to travel without impediment when traffic density is low, e.g. late in the evening, and on the contrary with great difficulty during the "rush" hours.

Other predictable factors that may be mentioned include the next:

the topography of the route followed by each of the waited-for buses, where "topography" covers, for example, the presence of traffic lights (and possibly even the times of day they are switched on), the widths of the streets taken, etc.; or past experience (e.g. congestion due to an open air market on a particular day of the week), etc.

Corrections can therefore be included systematically to correct the average speed included in the receiver members of the information system in order to take account of the said predictable factors.

However, it is not possible in that way to take account of unpredictable factors for example such as a traffic jam building up due to a collision between two vehicles, a parked vehicle blocking a bus lane, and the like.

To remedy that drawback, proposals have already been proposed whereby the "average speed" factor used for each of the waited-for buses is a variable, which variable is based at least in part on the real past average speed of said bus as previously measured and recorded, which speed relates to a predetermined length of the route of said bus, as defined by two fixed beacons (document GB-A-2 178 210).

The above formula gives results that are closer to reality than those obtained when using a constant for the average speed of each bus.

However it suffers from the next drawbacks:

if the length between beacons used for measuring the past real average speed is relatively short, then the result of the measurement is highly sensitive to fortuitous real circumstances that may have an abnormal effect locally on traffic (roadworks, unexpected behavior of a vehicle, and the like);

if each length between beacons used for measuring the past real average speed is, on the contrary, relatively long, then the measurement will give a result in which the real traffic conditions that obtain on the downstream portion of said length are swamped, at least in part, which downstream conditions are naturally of relatively greater importance in estimating the "average speed" factor exactly.

SUMMARY OF THE INVENTION

A particular aim of the invention is to remedy the above drawbacks.

To this end, according to the invention, information systems of the above kind are essentially characterized in that the quantity used as the "average speed" for each waited-for bus is a quantity that is determined on the basis of at least two past real average bus speeds, applicable to two different periods prior to the given instant under consideration.

In preferred embodiments of the invention, use is made of one or more of the next dispositions:

the number of past average speeds is equal to two, being $V_1$ and $V_2$, said speeds being calculated respectively for a relatively long time and for a relatively short time immediately prior to the given instant under consideration, and the past average speed used in the calculation is a weighted average speed equal to $\alpha V_1 + \beta V_2$, in which formula $\alpha$ and $\beta$ are two constants;

the sum of the two constants $\alpha+\beta$ is equal to 1;

the periods corresponding to calculation of the two past average speeds $V_1$ and $V_2$ are respectively of the order of 10 minutes to 20 minutes for the first speed and of the order of 30 seconds to 5 minutes for the second speed;

the calculation means are organized to give progressively increasing weight to the average speed $V_2$ corresponding to the shorter time as the instantaneous real distance between the "approaching bus" and the stop under consideration becomes shorter; and one of the past real average speeds of the bus is the real average speed as detected and recorded for at least one other bus preceding the bus in question.

Apart from these main dispositions, the invention includes certain other dispositions that are preferably used simultaneously therewith and that are explained in greater detail below.

Various preferred embodiments of the invention are described below with reference to the accompanying drawing, and naturally in non-limiting manner.

BRIEF DESCRIPTION OF THE DRAWINGS

The sole FIGURE in the drawing is a highly diagrammatic representation of a bus travelling along its line towards the next stop on the line, and also of an information system for users in accordance with the invention.

DESCRIPTION OF THE PREFERRED EMBODIMENTS

The bus that can be seen in the FIGURE is given reference 1, and the next stop is given reference 2.

The bus 1 is drawn in solid lines in the position that it occupies at an instant $T_0$ which is taken as the instant of display, with the present invention system being described as from said instant.

The bus is also shown in chain-dotted lines at two positions respectively referenced $\mathbf{1}_1$ and $\mathbf{1}_2$ and corresponding respectively to distances $D_1$ and $D_2$ behind the position it occupies at the instant $T_0$, which positions are described below.

The information system essentially comprises a station 3 provided with a transmit-receive antenna 4.

The station receives information from each bus 1 as it travels in the direction of arrow F along the line under consideration of the urban transport network.

This information transmitted to the antenna 4 in the form of electromagnetic waves 5 makes it possible in particular at each instant to determine the distance d between the bus 1 and the next stop 2 that it is to serve.

This distance d is one of the items of information that is then forwarded, in particular in the form of electromagnetic waves 6, to a receiver 7 located at the bus stop 2.

In known manner, the receiver 7 at the bus stop 2 includes means enabling the signals 6 to be received and decoded, and making it possible to select from the data contained in said signals or to calculate on the basis of said data, the waiting time at the stop 2 for the approaching bus 1, and to display this waiting time.

Naturally, in order to be able to calculate the waiting time at the stop 2 for the bus 1, it is necessary to know, in addition to the real distance between the bus and the stop, the real future average speed of displacement of the bus until it reaches the stop.

Instead of representing this future real average speed by a fixed coefficient K that cannot take traffic uncertainties into account, proposals have already been made to adopt a variable V for said future average speed, which variable corresponds to a past real average bus speed as detected and recorded and which is assumed to be good as an approximation to said future real average speed.

In known embodiments of that method, said past bus speed is the speed $V_1$ at which the bus 1 to which the display relates has itself travelled during a time $T_1$ preceding the interrogation instant $T_0$ and/or taken by the said bus to travel the distance $D_1$ situated immediately behind it.

In other words, the past real average speed $V_1$ is considered as being equal to the future real average speed of the bus 1 up to the stop 2.

In the station 3, or preferably at each receiver 7 in order to reduce the telecommunications burden, said speed $V_1$ may be determined, for example either by taking the time $T_1$ as a given quantity and measuring the distance $D_1$ travelled during said time $T_1$ on the basis of position data concerning the bus 1, as detected and recorded at successive instants, or else by taking the distance $D_1$ as a given quantity and determined as before, and by measuring the time duration $T_1$ required for travelling said distance.

The waiting time based on such a past real average speed $V_1$ taken as the probable average speed for future travel over the final distance d is calculated at each receiver 7 rather than in the station 3, thereby making it possible to reduce considerably the amount of data to be transmitted from the station 3 to the receivers.

That calculation is closer to reality than a calculation based on constant average speeds given a priori.

However, it suffers from the drawback mentioned above relating to the fact that the time allocated to measuring the speed is either too short or too long.

According to the invention, that drawback is remedied by no longer making use of a single past real average speed of the bus in question when calculating waiting time.

On the contrary, at least two such past real average speeds are used, which speeds are established over different time durations immediately prior to the instant of use.

In particular, account is taken of two past average speeds $V_1$ and $V_2$ corresponding respectively to a relatively long time $T_1$ and to a relatively short time $T_2$ or, and this amounts to the same thing, to a relatively long distance $D_1$ and a relatively short distance $D_2$.

By way of example, the time $T_2$ may lie in the range 10 minutes to 20 minutes, being typically equal to 15 minutes and corresponding on average to a travel distance $D_1$ of about 3 km, while the time $T_2$ may lie in the range 30 seconds to 5 minutes, with the corresponding distance $D_2$ then lying in the range 50 meters to 500 meters.

Each of these two average speeds has its own advantages and drawbacks.

The first speed $V_1$ relating to a long duration is not badly spoilt by unexpected slowdowns or successive stops of the bus, particularly at the various bus stops that it serves and also at traffic lights, and it therefore gives a relatively true image of the difficulties encountered by the bus in making progress during the interrogation period. However it suffers specifically from the drawback of integrating in general several such slowdowns or stops.

The second speed $V_2$ relating to a short duration is more accurate, and as the distance d between the bus 1 and the stop 2 become shorter, its accuracy increases, however it is more easily spoiled than the preceding speed by any slowdowns or stops of the bus.

In general, it can be considered that the average speed to be taken into consideration is given by the formula $\alpha V_1 + \beta V_2$, in which $\alpha$ and $\beta$ are constants, and in particular adding up to 1.

When the distance d is relatively long, it is advantageous to give priority to the average speed $V_1$ relating to the long period, thus setting $\alpha$ equal to 1 and $\beta$ equal to 0.

However, as the distance d becomes shorter, so it becomes advantageous to give increasing weight to the speed $V_2$ that relates to the short period, since it then becomes more and more likely that said second past speed $V_2$ will be equal to the real average speed of the bus 1 in question at the display instant concerned over the last part of its trip before the stop

2.

Thus, in a particularly advantageous embodiment of the invention, the receiver 7 is caused to include means for giving increasing weight to the speed $V_2$ as the bus 1 gets closer to the stop 2, with the coefficient $\beta$ progressively increasing up to unity at the expense of the coefficient $\alpha$, which preferably remains constantly equal to $1-\beta$.

In yet another advantageous embodiment, the next procedure is applied.

To define one of the two "average speed" parameters for each bus 1 waited for at a stop 2 and at the distance d therefrom, the average speed used is the real average speed of at least one of the buses preceding the waited-for bus while travelling over the same final distance d: this real speed can be calculated on the basis of stored data representing a certain number of positions successively occupied by said preceding bus along the final distance under consideration, said positions being associated with the respective corresponding instants at which they were occupied.

It can be assumed that the average speeds achieved by two successive buses over a portion of line of length d preceding the stop in question will be substantially the same.

The detected real average speed of the preceding bus may totally replace one of the real past average speeds calculated for the waited-for bus.

It may also be used merely as a correction term for said speeds.

Regardless of the embodiment used, it follows that an information system is provided for users of a bus network, and the structure and the operation thereof can be understood sufficiently from the above.

This information system presents numerous advantages over those known in the past, in particular the advantage of enabling relatively exact bus waiting times to be determined for display, said times taking account of the real difficulties encountered by the waited-for buses in the course of their travel.

Naturally, and as can be seen from the above, the invention is not limited in any way to the particular embodiments and applications envisaged more specifically; on the contrary, it encompasses all variants, and in particular:

those in which at least some of the receiver members included in the information system in question are not stationary as in the embodiment described above, but are constituted by portable appliances made available to users individually, each portable appliance possibly being of a "universal" type, i.e. organized to be capable of displaying, on request, waiting times for buses at any of the various stops in a network, in particular in the manner explained in French patent application No. 92 09042;

systems in which corrections for taking account of the above-defined "predictable factors" are applied to calculating the "average speed" parameter; and systems in which the electrical signals used by the receivers 7 are transmitted thereto from the station 3 over a path that is not electromagnetic, e.g. by wire.

We claim:

1. A system for informing the users of a bus network about the waiting times for buses at the stops of the bus network, the system comprising a transmitter facility for generating electrical signals representative of the distance between each bus travelling along a line of the network and the "next" stop served by said bus, and for transmitting said signals; and receiver means associated with at least one stop, for receiving said signals, for selecting, from said signals, selected signals that concern said stop, for generating data relating to the waiting time for each "approaching" bus on the basis of the selected signals, and for displaying said data; the waiting times in question being related to said distances by a parameter corresponding to the estimated future "average speed" for a given bus between its real position at each given instant and the position of a given stop, said parameter being based on a previously measured and recorded past real average bus speed, said system further comprising calculation means for determining said past real average bus speed on the basis of at least two past real average speeds, corresponding respectively to two periods having different durations prior to the given instant under consideration, said at least two past average speeds comprising two speeds $V_1$ and $V_2$, and said two speeds $V_1$ and $V_2$ being calculated, respectively, for a relatively long time and for a relatively short time immediately prior to said given instant under consideration, and being the past average speed used in the calculation being a weighted average speed equal to $\alpha V_1+\beta V_2$, wherein $\alpha$ and $\beta$ are constants, said calculation means giving progressively increasing weight to the average speed $V_2$ as the instantaneous real distance between the "approaching" bus and the given stop under consideration becomes shorter.

2. A system according to claim 1, wherein the sum $\alpha+\beta$ is equal to 1.

3. An information system according to claim 1, wherein the periods corresponding to calculation of the two past average speeds $V_1$ and $V_2$ are respectively of the order of 10 minutes to 20 minutes for the first speed and of the order of 30 seconds to 5 minutes for the second speed.

4. An information system according to claim 1, wherein one of the past average bus speeds used in calculating the waiting time for each bus at a given stop is the real average speed that has been measured and recorded for at least one other bus preceding said one bus.

* * * * *